US006599417B2

(12) United States Patent
Pradhan et al.

(10) Patent No.: US 6,599,417 B2
(45) **Date of Patent: *Jul. 29, 2003**

(54) SULFUR REMOVAL PROCESS

(75) Inventors: Vivek R. Pradhan, Aurora, IL (US); Ptoshia A. Burnett, Naperville, IL (US); George A. Huff, Naperville, IL (US)

(73) Assignee: BP Corporation North America Inc., Warrenville, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/489,392

(22) Filed: Jan. 21, 2000

(65) Prior Publication Data

US 2002/0121459 A1 Sep. 5, 2002

(51) Int. Cl.[7] ..... C10G 45/00; C10G 45/02

(52) U.S. Cl. ..... 208/211; 208/62; 208/66; 208/97; 208/213; 208/218; 208/88

(58) Field of Search ..... 208/62, 66, 97, 208/211, 213, 218, 88

(56) References Cited

U.S. PATENT DOCUMENTS

| | | | | |
|---|---|---|---|---|
| 2,120,702 A | | 6/1938 | Ipatieff et al. | 23/233 |
| 2,843,639 A | | 7/1958 | Langlois et al. | 260/683.15 |
| 2,921,081 A | | 1/1960 | Zimmerschied et al. | 260/329 |
| 2,999,807 A | | 9/1961 | Buningh et al. | 208/254 |
| 3,719,587 A | | 3/1973 | Karchmer et al. | 208/208 R |
| 3,953,323 A | * | 4/1976 | Nolan, Jr. et al. | 208/255 |
| 3,957,625 A | * | 5/1976 | Orkin | 208/211 |
| 4,171,260 A | | 10/1979 | Farcasiu et al. | 208/240 |
| 4,229,282 A | * | 10/1980 | Peters et al. | 208/111 |
| 4,397,739 A | * | 8/1983 | Jacquin et al. | 208/210 |
| 4,795,550 A | * | 1/1989 | Sachtler et al. | 208/307 |
| 4,973,790 A | | 11/1990 | Beech, Jr. et al. | 585/533 |
| 4,990,242 A | * | 2/1991 | Louie et al. | 208/218 |
| 5,120,890 A | | 6/1992 | Sachtler et al. | 585/449 |
| 5,171,916 A | | 12/1992 | Le et al. | 585/467 |
| 5,290,427 A | * | 3/1994 | Fletcher et al. | 208/89 |

(List continued on next page.)

FOREIGN PATENT DOCUMENTS

| | | | |
|---|---|---|---|
| EP | 0 359 874 A1 | 3/1990 | C10G/29/20 |
| GB | 863539 | 3/1961 | |
| WO | 89/08090 | 8/1989 | |
| WO | WO 98/30655 | 7/1998 | C10G/29/20 |

OTHER PUBLICATIONS

Vladimir Haensel and V.N. Ipateff, "Polytreating of Catalytically Cracked Gasolines", Oct. 1946, pp. 1045–1047.

G.E. Mapstone, "The Chemistry of the Acid Treatment of Gasoline," *Petroleum Refiner*, vol. 29, No. 11 (Nov. 1950), pp. 142–150.

*Primary Examiner*—Nadine G. Norton

(74) *Attorney, Agent, or Firm*—Patrick J. Kim; Ekkehard Schoettle

(57) ABSTRACT

A product of reduced sulfur content is produced from an olefin-containing hydrocarbon feedstock which includes sulfur-containing impurities. The feedstock is contacted with an olefin-modification catalyst in a reaction zone under conditions which are effective to produce an intermediate product which has a reduced amount of olefinic unsaturation relative to that of the feedstock as measured by bromine number. The intermediate product is then separated into fractions of different volatility, and the lowest boiling fraction is contacted with a hydrodesulfurization catalyst in the presence of hydrogen under conditions which are effective to convert at least a portion of its sulfur-containing impurities to hydrogen sulfide.

7 Claims, 1 Drawing Sheet

U.S. PATENT DOCUMENTS 5,298,150 A 3/1994 Fletcher et al. ..... 208/89
5,336,820 A 8/1994 Owen et al. ..... 585/323
5,346,609 A 9/1994 Fletcher et al. ..... 208/89
5,391,288 A 2/1995 Collins et al. ..... 208/89
5,409,596 A 4/1995 Fletcher et al. ..... 208/89
5,414,183 A * 5/1995 Abrevaya et al. ..... 585/671
5,510,568 A 4/1996 Hearn ..... 585/834
5,525,211 A 6/1996 Sudhakar et al. ..... 208/217
5,597,476 A 1/1997 Hearn et al. ..... 208/208 R
5,599,441 A * 2/1997 Collins et al. ..... 208/208 R
5,837,131 A 11/1998 Clark ..... 208/216 PP
5,853,570 A 12/1998 Hatanaka et al. ..... 208/216 PP
5,863,419 A 1/1999 Huff, Jr. et al. ..... 208/237
5,865,987 A * 2/1999 Borghard et al. ..... 208/97
5,865,988 A 2/1999 Collins et al. ..... 208/97
6,007,704 A * 12/1999 Chapus et al. ..... 208/218
6,048,451 A * 4/2000 Huff, Jr. et al. ..... 208/237
6,103,105 A * 8/2000 Cooper et al. ..... 208/210

* cited by examiner

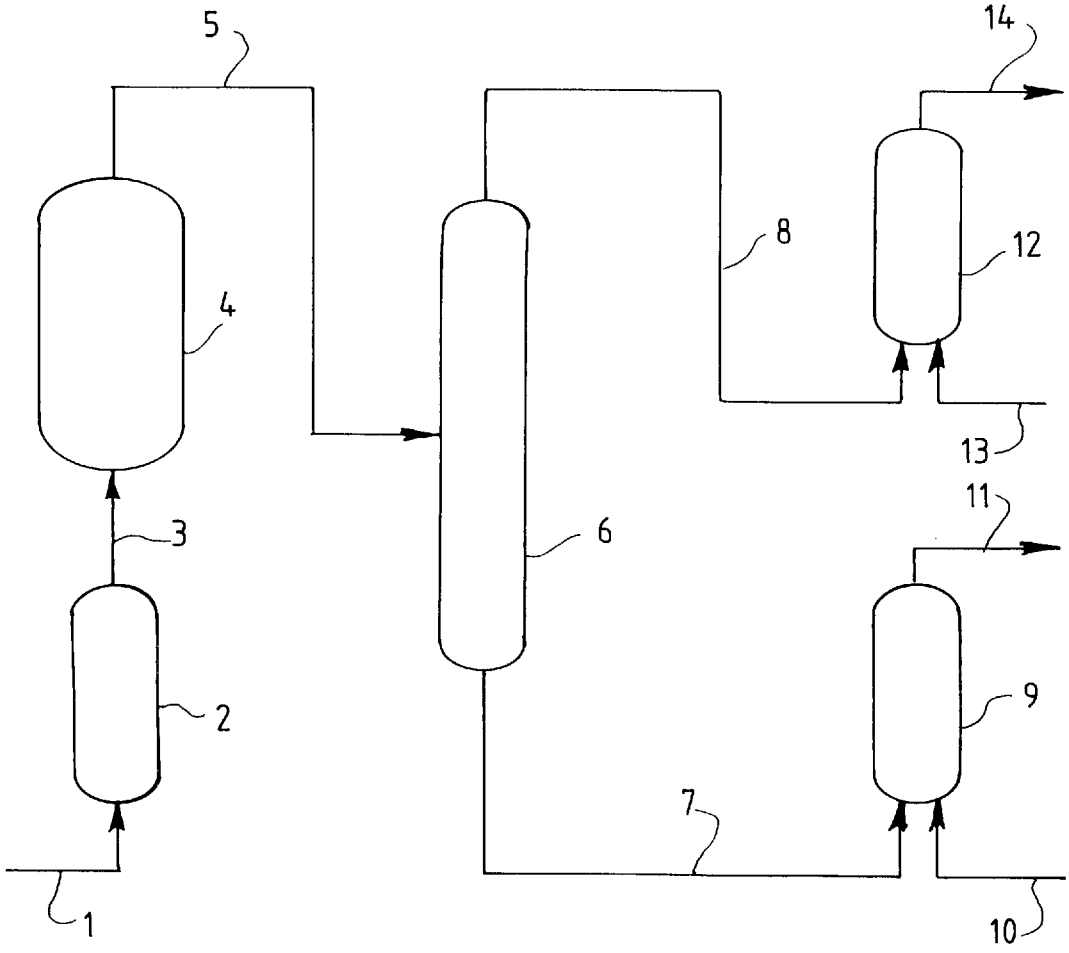
5
14
8
12
4
13
11
3
6
9
2
7
1
10

SULFUR REMOVAL PROCESS

FIELD OF THE INVENTION

This invention relates to a process for removing sulfur-containing impurities from olefin-containing hydrocarbon mixtures. More particularly, the process involves converting the feedstock to an intermediate product of reduced bromine number, separating the intermediate product into fractions of different boiling point, and subjecting the low boiling fraction to hydrodesulfurization.

BACKGROUND OF THE INVENTION

The fluidized catalytic cracking process is one of the major refining processes which is currently employed in the conversion of petroleum to desirable fuels such as gasoline and diesel fuel. In this process, a high molecular weight hydrocarbon feedstock is converted to lower molecular weight products through contact with hot, finely-divided, solid catalyst particles in a fluidized or dispersed state. Suitable hydrocarbon feedstocks typically boil within the range from about 205° C. to about 650° C., and they are usually contacted with the catalyst at temperatures in the range from about 450° C. to about 650° C. Suitable feedstocks include various mineral oil fractions such as light gas oils, heavy gas oils, wide-cut gas oils, vacuum gas oils, kerosenes, decanted oils, residual fractions, reduced crude oils and cycle oils which are derived from any of these as well as fractions derived from shale oils, tar sands processing, and coal liquefaction. Products from a fluidized catalytic cracking process are typically based on boiling point and include light naphtha (boiling between about 10° C. and about 221° C.), heavy naphtha (boiling between about 10° C. and about 249° C.), kerosene (boiling between about 180° C. and about 300° C.), light cycle oil (boiling between about 221° C. and about 345° C.), and heavy cycle oil (boiling at temperatures higher than about 345° C.).

Naphtha from a catalytic cracking process comprises a complex blend of hydrocarbons which includes paraffins (also known as alkanes), cycloparaffins (also known as cycloalkanes or naphthenes), olefins (as used herein, the term olefin includes all acyclic and cyclic hydrocarbons which contain at least one double bond and are not aromatic), and aromatic compounds. Such a material typically contains a relatively high olefin content and includes significant amounts of sulfur-containing aromatic compounds, such as thiophenic and benzothiophenic compounds, as impurities. For example, a light naphtha from the fluidized catalytic cracking of a petroleum derived gas oil can contain up to about 60 wt. % of olefins and up to about 0.7 wt. % of sulfur wherein most of the sulfur will be in the form of thiophenic and benzothiophenic compounds. However, a typical naphtha from the catalytic cracking process will usually contain from about 5 wt. % to about 40 wt. % olefins and from about 0.07 wt. % to about 0.5 wt. % sulfur.

Not only does the fluidized catalytic cracking process provide a significant part of the gasoline pool in the United States, it also provides a large proportion of the sulfur that appears in this pool. The sulfur in the liquid products from this process is in the form of organic sulfur compounds and is an undesirable impurity which is converted to sulfur oxides when these products are utilized as a fuel. The sulfur oxides are objectionable air pollutants. In addition, they can deactivate many of the catalysts that have been developed for the catalytic converters which are used on automobiles to catalyze the conversion of harmful engine exhaust emissions to gases which are less objectionable. Accordingly, it is desirable to reduce the sulfur content of catalytic cracking products to the lowest possible levels.

Low sulfur products are conventionally obtained from the catalytic cracking process by hydrotreating either the feedstock to the process or the products from the process. The hydrotreating process involves treatment of the feedstock with hydrogen in the presence of a catalyst and results in the conversion of the sulfur in the sulfur-containing impurities to hydrogen sulfide, which can be separated and converted to elemental sulfur. The hydrotreating process can result in the destruction of olefins in the feedstock by converting them to saturated hydrocarbons through hydrogenation. This destruction of olefins by hydrogenation is usually undesirable because: (1) it results in the consumption of expensive hydrogen, and (2) the olefins are usually valuable as high octane components of gasoline. As an example, a typical naphtha of gasoline boiling range from a catalytic cracking process has a relatively high octane number as a result of a large olefin content. Hydrotreating such a material causes a reduction in the olefin content in addition to the desired desulfurization, and the octane number of the hydrotreated product decreases as the degree or severity of the desulfurization increases.

U.S. Pa. No. 5,865,988 (Collins et al.) is directed to a two step process for the production of low sulfur gasoline from an olefinic, cracked, sulfur-containing naphtha. The process involves: (a) passing the naphtha over a shape selective acidic catalyst, such as ZSM-5 zeolite, to selectively crack low octane paraffins and to convert some of the olefins and naphthenes to aromatics and aromatic side chains; and (2) hydrodesulfurizing the resulting product over a hydrotreating catalyst in the presence of hydrogen. It is disclosed that the initial treatment with the shape selective acidic catalyst removes the olefins which would otherwise be saturated in the hydrodesulfurization step.

International Patent Application No. WO 98/30655 (Huff et al.), published under the Patent Cooperation Treaty, discloses a process for the production of a product of reduced sulfur content from a feedstock wherein the feedstock is comprised of a mixture of hydrocarbons and contains organic sulfur compounds as unwanted impurities. This process involves converting at least a portion of the sulfur-containing impurities to sulfur-containing products of a higher boiling point by treatment with an alkylating agent in the presence of an acid catalyst and removing at least a portion of these higher boiling products by fractionation on the basis of boiling point.

U.S. Pat. Nos. 5,298,150 (Fletcher et al.); 5,346,609 (Fletcher et al.); 5,391,288 (Collins et al.); and 5,409,596 (Fletcher et al.) are all directed to a two step process for the preparation of a low sulfur gasoline wherein a naphtha feedstock is subjected to hydrodesulfurization followed by treatment with a shape selective catalyst to restore the octane which is lost during the hydrodesulfurization step.

U.S. Pat. No. 5,171,916 (Le et al.) is directed to a process for upgrading a light cycle oil by: (1) alkylating the heteroatom containing aromatics of the cycle oil with an aliphatic hydrocarbon having at least one olefinic double bond through the use of a crystalline metallosilicate catalyst; and (2) separating the high boiling alkylation product by fractional distillation. It is disclosed that the unconverted light cycle oil has a reduced sulfur and nitrogen content, and the high boiling alkylation product is useful as a synthetic alkylated aromatic functional fluid base stock.

U.S. Pat. No. 5,599,441 (Collins et al.) discloses a process for removing thiophenic sulfur compounds from a cracked naphtha by: (1) contacting the naphtha with an acid catalyst in an alkylation zone to alkylate the thiophenic compounds using the olefins present in the naphtha as an alkylating agent; (2) removing an effluent stream from the alkylation zone; and (3) separating the alkylated thiophenic compounds from the alkylation zone effluent stream by fractional distillation. It is also disclosed that the sulfur-rich high boiling fraction from the fractional distillation may be desulfurized using conventional hydrotreating or other desulfurization processes.

U.S. Pat. No. 5,863,419 (Huff, Jr. et al.) discloses a catalytic distillation process for the production of a product of reduced sulfur content from a feedstock wherein the feedstock is comprised of a mixture of hydrocarbons which contains organic sulfur compounds as unwanted impurities. The process involves carrying out the following process steps simultaneously within a distillation column reactor: (1) converting at least a portion of the sulfur-containing impurities to sulfur-containing products of a higher boiling point by treatment with an alkylating agent in the presence of an acid catalyst; and (2) removing at least a portion of these higher boiling products by fractional distillation. It is also disclosed that the sulfur-rich high boiling fraction can be efficiently hydrotreated at relatively low cost because of its reduced volume relative to that of the original feedstock.

SUMMARY OF THE INVENTION

Hydrocarbon liquids which boil at standard pressure over either a broad or a narrow range of temperatures within the range from about 10° C. to about 345° C. are referred to herein as "hydrocarbon liquids." Such liquids are frequently encountered in the refining of petroleum and also in the refining of products from coal liquefaction and the processing of oil shale or tar sands, and these liquids are typically comprised of a complex mixture of hydrocarbons, and these mixtures can include paraffins, cycloparaffins, olefins and aromatics. For example, light naphtha, heavy naphtha, gasoline, kerosene and light cycle oil are all hydrocarbon liquids.

Hydrocarbon liquids which are encountered in a refinery frequently contain undesirable sulfur-containing impurities which must be at least partially removed. Hydrotreating procedures are effective and are commonly used for removing sulfur-containing impurities from hydrocarbon liquids. Unfortunately, conventional hydrotreating processes are usually unsatisfactory for use with highly olefinic hydrocarbon liquids because such processes result in significant conversion of the olefins to paraffins which are usually of lower octane. In addition, the hydrogenation of the olefins results in the consumption of expensive hydrogen.

Organic sulfur compounds can also be removed from hydrocarbon liquids by a multiple step process which comprises: (1) conversion of the sulfur compounds to products of higher boiling point by alkylation; and (2) removal of the higher boiling products by fractional distillation. Such a process is relatively inexpensive to carry out, and it does not usually result in any significant octane loss. Although this type of process is quite effective in removing a large portion of aromatic, sulfur-containing, organic impurities, such as thiophenic and benzothiophenic compounds, the product from such a process will typically contain a much reduced but still significant sulfur content. In addition, such a process is frequently not very satisfactory in removing other common types of sulfur containing impurities, such as mercaptans.

Accordingly, there is a need for a process which can achieve a substantially complete removal of sulfur-containing impurities from olefin-containing hydrocarbon liquids which: (1) is inexpensive to carry out, and (2) results in little if any octane loss. For example, there is a need for such a process which can be used to remove sulfur-containing impurities from hydrocarbon liquids, such as products from a fluidized catalytic cracking process, which are highly olefinic and contain relatively large amounts of sulfur-containing organic materials such as mercaptans, thiophenic compounds, and benzothiophenic compounds as unwanted impurities.

We have discovered such an improved process which involves modifying the olefin content of the feedstock over an olefin-modification catalyst in an olefin-modification step, fractionating the products from the olefin-modification step into at least two fractions on the basis of boiling point, and hydrodesulfurizing at least the lowest boiling of the resulting fractions. The olefin-modification step results in a reduction of the olefinic unsaturation of the feedstock, as measured by bromine number. As a consequence of the olefin-modification step, a product is obtained from the subsequent hydrodesulfurization step which has little loss of octane relative to that of the feedstock to the olefin-modification step. In addition, the reduction of olefinic unsaturation in the olefin-modification step results in a corresponding reduction of hydrogen consumption in the hydrodesulfurization step since there is a reduced number of olefinic double bonds to consume hydrogen in hydrogenation reactions.

One embodiment of the invention is a process for producing a product of reduced sulfur content from a feedstock, wherein said feedstock contains sulfur-containing organic impurities and is comprised of a normally liquid mixture of hydrocarbons which includes olefins, said process comprising:

(a) contacting the feedstock with an olefin-modification catalyst in an olefin-modification reaction zone under conditions which are effective to produce a product having a bromine number which is lower than that of the feedstock;

(b) fractionating the product from said olefin-modification reaction zone to produce:

(i) a first fraction which comprises sulfur-containing organic impurities and has a distillation endpoint which is in the range from about 135° C. to about 221° C.; and (ii) a second fraction which is higher boiling than the first fraction and comprises sulfur-containing organic impurities; and (c) contacting said first fraction with a hydrodesulfurization catalyst in the presence of hydrogen in a first hydrodesulfurization reaction zone under conditions which are effective to convert at least a portion of the sulfur in said sulfur-containing impurities of the first fraction to hydrogen sulfide.

Another embodiment of the invention is a process for producing products of reduced sulfur content from a feedstock, wherein said feedstock contains sulfur-containing organic impurities and is comprised of a normally liquid mixture of hydrocarbons which includes olefins, said process comprising:

(a) contacting the feedstock with an olefin-modification catalyst in an olefin-modification reaction zone under conditions which are effective to produce a product which has a lower bromine number than that of the feedstock, wherein said olefin-modification catalyst is selected from the group consisting of solid phosphoric acid catalysts and acidic polymeric resin catalysts;

(b) fractionating the product from said olefin-modification reaction zone to produce:

(i) a first fraction which contains sulfur-containing organic impurities and has a distillation endpoint which is in the range from about 135° C. to about 221° C.; and (ii) a second fraction which is higher boiling than the first fraction and contains sulfur-containing organic impurities; and (c) contacting said first fraction with a hydrodesulfurization catalyst in the presence of hydrogen in a first hydrodesulfurization reaction zone under conditions which are effective to convert at least a portion of the sulfur in said sulfur-containing impurities of the first fraction to hydrogen sulfide.

An object of the invention is to provide an improved process for the removal of sulfur-containing impurities from a hydrocarbon liquid which contains a significant olefin content.

Another object of the invention is to provide an improved method for the efficient removal of sulfur-containing impurities from an olefinic cracked naphtha.

A further object of the invention is to provide an improved method for desulfurizing an olefinic cracked naphtha which yields a product of substantially unchanged octane.

BRIEF DESCRIPTION OF THE DRAWING

The drawing is a schematic representation of an embodiment of the invention.

DETAILED DESCRIPTION OF THE INVENTION

We have discovered a process for the production of a product of reduced sulfur content from an olefin-containing distillate hydrocarbon liquid which contains sulfur-containing impurities. The process can be used to produce a product which is substantially free of sulfur-containing impurities, has a reduced olefin content, and has an octane which is similar to that of the feedstock.

The invention involves contacting the feedstock with an olefin-modification catalyst in a reaction zone under conditions which are effective to produce an intermediate product which has a reduced amount of olefinic unsaturation relative to that of the feedstock as measured by bromine number. The intermediate product is then separated into fractions of different volatility, and the fraction of highest volatility (i.e., the lowest boiling fraction) is contacted with a hydrodesulfurization catalyst in the presence of hydrogen under conditions which are effective to convert at least a portion of its sulfur-containing organic impurities to hydrogen sulfide. The hydrogen sulfide can be easily removed by conventional methods to provide a product of substantially reduced sulfur content relative to that of the feedstock. A large portion of the sulfur-containing impurities of this lowest boiling fraction will frequently be comprised of mercaptans, which can be easily removed by hydrodesulfurization under very mild conditions.

Aromatic sulfur-containing impurities in the feedstock, such as thiophenic and benzothiophenic compounds, undergo conversion, at least in part, within the olefin-modification reaction zone to higher boiling sulfur-containing products. This conversion is believed to be a result of alkylation of the aromatic sulfur-containing impurities by olefins which is catalyzed by the olefin-modification catalyst. Upon fractionation of the effluent from the olefin-modification reaction zone, most of these high boiling sulfur-containing materials appear in the higher boiling fraction or fractions, and the lower boiling fraction has a reduced sulfur content relative to that of the feedstock.

In a highly preferred embodiment, the lower volatility fraction or fractions (i.e., the higher boiling fraction or fractions) are also contacted with a hydrodesulfurization catalyst in the presence of hydrogen under conditions which are effective to convert at least a portion of their sulfur-containing impurities to hydrogen sulfide. A large portion of the sulfur-containing impurities of the higher boiling fraction or fractions will frequently be comprised of aromatic sulfur-containing compounds, such as thiophenic and benzothiophenic compounds, which are somewhat more difficult to remove by hydrodesulfurization than mercaptans. Accordingly, a preferred embodiment of the invention will comprise the use of more vigorous hydrodesulfurization conditions with such higher boiling fraction or fractions in comparison to those employed for the fraction of lowest boiling point.

Feedstocks which can be used in the practice of this invention are comprised of normally liquid hydrocarbon mixtures which contain olefins and boil over a range of temperatures within the range from about 10° C. to about 345° C. as measured by the ASTM D 2887-97 a procedure (which can be found in the 1999 Annual Book of ASTM Standards, Section 5, Petroleum Products, Lubricants, and Fossil Fuels, Vol. 05.02, page 200, and said procedure is hereby incorporated herein by reference in its entirety) or by conventional alternative procedures. In addition, suitable feedstocks will preferably include a mixture of hydrocarbons which boils in the gasoline range. Highly suitable feedstocks will contain a high volatility fraction which has a distillation endpoint in the range from about 135° to about 221° C. If desired, such feedstocks can also contain significant amounts of lower volatility hydrocarbon components which have a higher boiling point than said high volatility fraction. The feedstock will be comprised of a normally liquid mixture of hydrocarbons which desirably has a distillation endpoint which is about 345° C. or lower, and is preferably about 249° C. or lower. Preferably, the feedstock will have an initial boiling point which is below about 79° C. and a distillation endpoint which is not greater than about 345° C. Suitable feedstocks include any of the various complex mixtures of hydrocarbons which are conventionally encountered in the refining of petroleum, such as natural gas liquids, naphthas, light gas oils, heavy gas oils, and wide-cut gas oils, as well as hydrocarbon fractions which are derived from coal liquefaction and the processing of oil shale or tar sands. Preferred feedstocks are comprised of olefin-containing hydrocarbon mixtures which are derived from the catalytic cracking or the coking of hydrocarbon feedstocks.

Catalytic cracking products are highly preferred as a source of feedstock hydrocarbons for use in the subject invention. Materials of this type include liquids which boil below about 345° C., such as light naphtha, heavy naphtha and light cycle oil. However, it will also be appreciated that the entire output of volatile products from a catalytic cracking process can be utilized as a source of feedstock hydrocarbons for use in the practice of this invention. Catalytic cracking products are a desirable source of feedstock hydrocarbons because they typically have a relatively high olefin content and they usually contain substantial amounts of organic sulfur compounds as impurities. For example, a light naphtha from the fluidized catalytic cracking of a petroleum derived gas oil can contain up to about 60 wt. % of olefins and up to about 0.7 wt. % of sulfur wherein most of the sulfur will be in the form of thiophenic and benzothiophenic compounds. In addition, the sulfur-containing impurities will usually include mercaptans and organic sulfides. A preferred feedstock for use in the practice of this invention will be comprised of catalytic cracking products and will contain at least 1 wt. % of olefins. A preferred feedstock will be comprised of hydrocarbons from a catalytic cracking process and will contain at least 10 wt. % of olefins. A highly preferred feedstock will be comprised of hydrocarbons from a catalytic cracking process and will contain at least about 15 wt. % or 20 wt. % of olefins.

In one embodiment of the invention, the feedstock for the invention will be comprised of a mixture of low molecular weight olefins with hydrocarbons from a catalytic cracking process. For example, a feedstock can be prepared by adding olefins which contain from 3 to 5 carbon atoms to a naphtha from a catalytic cracking process.

In another embodiment of the invention, the feedstock for the invention will be comprised of a mixture of a naphtha from a catalytic cracking process with a source of volatile aromatic compounds, such as benzene and toluene. For example, a feedstock can be prepared by mixing a light reformate with a naphtha from a catalytic cracking process. A typical light reformate will contain from about 0 to about 2 vol. % olefins, from about 20 to about 45 vol. % aromatics, and will have distillation properties such that the 10% distillation point ("T10") is no greater than about 160° F. (71° C.), the 50% distillation point ("T50") is no greater than about 200° F. (93° C.), and the 90% distillation point ("T90") is no greater than about 250° F. (121° C.). It will be understood that these distillation points refer to a distillation point obtained by the ASTM D 86-97 procedure (which can be found in the 1999 Annual Book of ASTM Standards, Section 5, Petroleum Products, Lubricants, and Fossil Fuels, Vol. 05.01, page 16, and said procedure is hereby incorporated herein by reference in its entirety) or by conventional alternative procedures. A typical light reformate will contain from about 5 to about 15 vol. % of benzene.

Another embodiment of the invention involves the use of a feedstock which is comprised of a mixture of: (1) hydrocarbons from a catalytic cracking process; (2) a source of volatile aromatic compounds; and (3) a source of olefins which contain from 3 to 5 carbon atoms.

Suitable feedstocks for the invention will contain at least 1 wt. % of olefins, preferably at least 10 wt. % of olefins, and more preferably at least about 15 wt. % or 20 wt. % of olefins. If desired, the feedstock can have an olefin content of 50 wt. % or more. In addition, suitable feedstocks can contain from about 0.005 wt. % up to about 2.0 wt. % of sulfur in the form of organic sulfur compounds. However, typical feedstocks will generally contain from about 0.05 wt. % up to about 0.7 wt. % sulfur in the form of organic sulfur compounds.

Feedstocks which are useful in the practice of this invention, such as naphtha from a catalytic cracking process, will occasionally contain nitrogen-containing organic compounds as impurities in addition to the sulfur-containing impurities. Many of the typical nitrogen-containing impurities are organic bases and, in some instances, can cause a relatively rapid deactivation of the olefin-modification catalyst of the subject invention. In the event that such deactivation is observed, it can be prevented by removal of the basic nitrogen-containing impurities before they can contact the olefin-modification catalyst. Accordingly, when the feedstock contains basic nitrogen-containing impurities, a preferred embodiment of the invention comprises removing these basic nitrogen-containing impurities from the feedstock before it is contacted with the olefin-modification catalyst. In another embodiment of the invention, a feedstock is used which is substantially free of basic nitrogen-containing impurities (for example, such a feedstock will contain less than about 50 ppm by weight of basic nitrogen). A highly desirable feedstock is comprised of a treated naphtha which is prepared by removing basic nitrogen-containing impurities from a naphtha produced by a catalytic cracking process.

Basic nitrogen-containing impurities can be removed from the feedstock or from a material that is to be used as a feedstock component by any conventional method. Such methods typically involve treatment with an acidic material, and conventional methods include procedures such as washing with an aqueous solution of an acid or passing the material through a guard bed. In addition, a combination of such procedures can be used. Guard beds can be comprised of materials which include but are not limited to A-zeolite, Y-zeolite, L-zeolite, mordenite, fluorided alumina, fresh cracking catalyst, equilibrium cracking catalyst and acidic polymeric resins. If a guard bed technique is employed, it is often desirable to use two guard beds in such a manner that one guard bed can be regenerated while the other is in service. If a cracking catalyst is utilized to remove basic nitrogen-containing impurities, such a material can be regenerated in the regenerator of a catalytic cracking unit when it has become deactivated with respect to its ability to remove such impurities. If an acid wash is used to remove basic nitrogen-containing compounds, the treatment will be carried out with an aqueous solution of a suitable acid. Suitable acids for such use include but are not limited to hydrochloric acid, sulfuric acid and acetic acid. The concentration of acid in the aqueous solution is not critical, but is conveniently chosen to be in the range from about 0.5 wt. % to about 30 wt. %. For example, a 5 wt. % solution of sulfuric acid in water can be used to remove basic nitrogen containing impurities from a heavy naphtha produced by a catalytic cracking process.

The process of this invention is highly effective in removing sulfur-containing organic impurities of all types from the feedstock. Such impurities will typically include aromatic, sulfur-containing, organic compounds which include all aromatic organic compounds which contain at least one sulfur atom. Such materials include thiophenic and benzothiophenic compounds, and examples of such materials include but are not limited to thiophene, 2-methylthiophene, 3-methylthiophene, 2,3-dimethylthiophene, 2,5-dimethylthiophene, 2-ethylthiophene, 3-ethylthiophene, benzothiophene, 2-methylbenzothiophene, 2,3-dimethylbenzothiophene, and 3-ethylbenzothiophene. Other typical sulfur-containing impurities include mercaptans and organic sulfides and disulfides.

The olefin-modification catalyst of the invention can be comprised of any material which is capable of catalyzing the oligomerization of olefins. Desirably, the olefin-modification catalyst will be comprised of a material which is also capable of catalyzing the alkylation of aromatic organic compounds by olefins. Conventional alkylation catalysts are highly suitable for use as the olefin-modification catalyst of this invention because they typically have the ability to catalyze both olefin oligomerization and the alkylation of aromatic organic compounds by olefins. Although liquid acids, such as sulfuric acid can be used, solid acidic catalysts are particularly desirable, and such solid acidic catalysts include liquid acids which are supported on a solid substrate. The solid catalysts are generally preferred over liquid catalysts because of the ease with which the feed can be contacted with such a material. For example, the feed can simply be passed through one or more fixed beds of solid particulate catalyst at a suitable temperature. Alternatively, the feed can be passed through an ebulated bed of solid particulate catalyst.

Olefin-modification catalysts which are suitable for use in the practice of the invention can be comprised of materials such as acidic polymeric resins, supported acids, and acidic inorganic oxides. Suitable acidic polymeric resins include the polymeric sulfonic acid resins which are well-known in the art and are commercially available. Amberlyst® 35, a product produced by Rohm and Haas Co., is a typical example of such a material.

Supported acids which are useful as olefin-modification catalysts include but are not limited to Brönsted acids (examples include phosphoric acid, sulfuric acid, boric acid, HF, fluorosulfonic acid, trifluoromethanesulfonic acid, and dihydroxyfluoroboric acid) and Lewis acids (examples include $BF_3$, $BCl_3$, $AlCl_3$, $AlBr_3$, $FeCl_2$, $FeCl_3$, $ZnCl_2$, $SbF_5$, $SbCl_5$ and combinations of $AlCl_3$ and HCl) which are supported on solids such as silica, alumina, silica-aluminas, zirconium oxide or clays. When supported liquid acids are employed, the supported catalysts are typically prepared by combining the desired liquid acid with the desired support and drying. Supported catalysts which are prepared by combining a phosphoric acid with a support are highly preferred and are referred to herein as solid phosphoric acid catalysts. These catalysts are preferred because they are both highly effective and low in cost. U.S. Pat. No. 2,921,081 (Zimmerschied et al.), which is incorporated herein by reference in its entirety, discloses the preparation of solid phosphoric acid catalysts by combining a zirconium compound selected from the group consisting of zirconium oxide and the halides of zirconium with an acid selected from the group consisting of orthophosphoric acid, pyrophosphoric acid and triphosphoric acid. U.S. Pat. No. 2,120,702 (Ipatieff et al.), which is incorporated herein by reference in its entirety, discloses the preparation of solid phosphoric acid catalysts by combining a phosphoric acid with a siliceous material. Finally, British Patent No. 863,539, which is incorporated herein by reference in its entirety, also discloses the preparation of a solid phosphoric acid catalyst by depositing a phosphoric acid on a solid siliceous material such as diatomaceous earth or kieselguhr.

With respect to a solid phosphoric acid that is prepared by depositing a phosphoric acid on kieselguhr, it is believed that the catalyst contains: (1) one or more free phosphoric acids (such as orthophosphoric acid, pyrophosphoric acid and triphosphoric acid) supported on kieselguhr; and (2) silicon phosphates which are derived from the chemical reaction of the acid or acids with the kieselguhr. While the anhydrous silicon phosphates are believed to be inactive as an olefin-modification catalyst, it is also believed that they can be hydrolyzed to yield a mixture of orthophosphoric and polyphosphoric acids which is active as an olefin-modification catalyst. The precise composition of this mixture will depend upon the amount of water to which the catalyst is exposed. In order to maintain a solid phosphoric acid alkylation catalyst at a satisfactory level of activity when it is used as an olefin-modification catalyst with a substantially anhydrous feedstock, it is conventional practice to add a small amount of an alcohol, such as isopropyl alcohol, to the feedstock to maintain the catalyst at a satisfactory level of hydration. It is believed that the alcohol undergoes dehydration upon contact with the catalyst, and that the resulting water then acts to hydrate the catalyst. If the catalyst contains too little water, it tends to have a very high acidity which can lead to rapid deactivation as a consequence of coking and, in addition, the catalyst will not possess a good physical integrity. Further hydration of the catalyst serves to reduce its acidity and reduces its tendency toward rapid deactivation through coke formation. However, excessive hydration of such a catalyst can cause the catalyst to soften, physically agglomerate, and create high pressure drops in fixed bed reactors. Accordingly, there is an optimum level of hydration for a solid phosphoric acid catalyst, and this level of hydration will be a function of the reaction conditions. Although the invention is not to be so limited, with solid phosphoric acid catalysts, we have found that a water concentration in the feedstock which is in the range from abut 50 to about 1,000 ppm by weight will generally maintain a satisfactory level of catalyst hydration. If desired, this water can be provided in the form of an alcohol such as isopropyl alcohol which is believed to undergo dehydration upon contact with the catalyst.

Acidic inorganic oxides which are useful as olefin-modification catalysts include but are not limited to aluminas, silica-aluminas, natural and synthetic pillared clays, and natural and synthetic zeolites such as faujasites, mordenites, L, omega, X, Y, beta, and ZSM zeolites. Highly suitable zeolites include beta, Y, ZSM-3, ZSM-4, ZSM-5, ZSM-18, and ZSM-20. If desired, the zeolites can be incorporated into an inorganic oxide matrix material such as a silica-alumina.

Olefin-modification catalysts can comprise mixtures of different materials, such as a Lewis acid (examples include $BF_3$, $BCl_3$, $SbF_5$ and $AlCl_3$), a nonzeolitic solid inorganic oxide (such as silica, alumina and silica-alumina), and a large-pore crystalline molecular sieve (examples include zeolites, pillared clays and aluminophosphates).

In the event that a solid olefin-modification catalyst is used, it will desirably be in a physical form which will permit a rapid and effective contacting with feed in the olefin-modification reaction zone. Although the invention is not to be so limited, it is preferred that a solid catalyst be in particulate form wherein the largest dimension of the particles has an average value which is in the range from about 0.1 mm to about 2 cm. For example, substantially spherical beads of catalyst can be used which have an average diameter from about 0.1 mm to about 2 cm. Alternatively, the catalyst can be used in the form of rods which have a diameter in the range from about 0.1 mm to about 1 cm and a length in the range from about 0.2 mm to about 2 cm.

In the practice of the invention, the feedstock is contacted with an olefin-modification catalyst in an olefin-modification reaction zone under conditions which are effective to produce a product having a bromine number which is lower than that of the feedstock without causing any significant cracking of any paraffins in the feedstock. It will be understood that the "bromine number" referred to herein is preferably determined by the ASTM D 1159-98 procedure, which can be found in the 1999 Annual Book of ASTM Standards, Section 5, Petroleum Products, Lubricants, and Fossil Fuels, Vol. 05.01, page 407, and said procedure is hereby incorporated herein by reference in its entirety. However, other conventional analytical procedures for the determination of bromine number can also be used. The bromine number of the product from the olefin-modification reaction zone will desirably be no greater than 80% that of the feedstock to said reaction zone, preferably no greater than 70% that of said feedstock, and more preferably no greater than 65% that of said feedstock.

The conditions utilized in the olefin-modification reaction zone are also preferably selected so that at least a portion of the olefins in the feedstock is converted to products which are of a suitable volatility to be useful as components of fuels, such as gasoline and diesel fuels.

Although the invention is not to be so limited, it is believed that the olefins in the feedstock to the olefin-modification reaction zone are at least partially consumed in a variety of chemical reactions upon contact of the feedstock with the olefin-modification catalyst in said zone. And it is believed that the specific chemical reactions will depend upon the composition of the feedstock. These chemical processes are believed to include olefin polymerization and the alkylation of aromatic compounds by olefins.

The condensation reaction of an olefin or a mixture of olefins over an olefin-modification catalyst to form higher molecular weight products is referred to herein as a polymerization process, and the products can be either low molecular weight oligomers or high molecular weight polymers. Oligomers are formed by the condensation of 2, 3 or 4 olefin molecules with each other, while polymers are formed by the condensation of 5 or more olefin molecules with each other. As used herein, the term "polymerization" is used to broadly refer to a process for the formation of oligomers and/or polymers. Olefin polymerization results in a consumption of olefinic unsaturation. For example, the simple condensation of two molecules of propene results in the formation of a six carbon olefin which has only a single olefinic double bond (2 double bonds in the starting materials have been replaced by 1 double bond in the product). Similarly, the simple condensation of three molecules of propene results in the formation of a nine carbon olefin which has only a single olefinic double bond (3 double bonds in the starting materials have been replaced by 1 double bond in the product).

Although olefin polymerization is a simple model for understanding the reduction in bromine number that occurs in the olefin-modification reaction zone, it is believed that other processes are also important. For example, the initial products of simple olefin condensation can undergo isomerization in the presence of the olefin-modification catalyst to yield highly branched monounsaturated olefins. In addition, polymerization reactions may occur to yield polymers which subsequently undergo fragmentation in the presence of the olefin-modification catalyst to yield highly branched products which are of a lower molecular weight than the initial polymerization product. Although the invention is not to be so limited, it is believed that the following transformations occur within the olefin-modification reaction zone: (1) olefins in the feedstock which are of low molecular weight are converted to olefins of higher molecular weight which are both highly branched and within the gasoline boiling range; and (2) unbranched or modestly branched olefins in the feedstock are isomerized to highly branched olefins which are within the gasoline boiling range.

The alkylation of aromatic compounds is also an important chemical process which can occur in the olefin-modification reaction zone and acts to reduce the bromine number of the feedstock. The alkylation of an aromatic organic compound by an olefin, which contains a single double bond, results in the destruction of the double bond of the olefin and results in the substitution of an alkyl group for a hydrogen atom on the aromatic ring system of the substrate. This destruction of the olefinic double bond of the olefin contributes to the formation of a product in the olefin-modification reaction zone which has a reduced bromine number relative to that of the feedstock. However, aromatic organic compounds vary widely in their reactivity as alkylation substrates. For example, the relative reactivities of some representative aromatic compounds toward alkylation by 1-heptene at 204° C. over a solid phosphoric acid catalyst are set forth in Table I, wherein each rate constant was derived from the slope of the line obtained by plotting experimental data in the form of ln(1−x) as a function of time where x is the substrate concentration.

As used herein, the term "sulfur-containing aromatic compound" and "sulfur-containing aromatic impurity" refer to any aromatic organic compound which contains at least one sulfur atom in its aromatic ring system. Such materials include thiophenic and benzothiophenic compounds.

Sulfur-containing aromatic compounds are usually alkylated more rapidly than aromatic hydrocarbons. Accordingly, the sulfur-containing aromatic impurities can, to a limited degree, be selectively alkylated in the olefin-modification reaction zone. However, if desired, the reaction conditions in the reaction zone can be selected so that significant alkylation of aromatic hydrocarbons does take place. This embodiment of the invention can be very useful if the feedstock contains volatile aromatic hydrocarbons, such as benzene, and it is desired to destroy such material by conversion to higher molecular weight alkylation products. This embodiment is particularly useful when the feedstock contains significant amounts of low molecular weight olefins, such as olefins which contain from 3 to 5 carbon atoms. The products from mono- or dialkylation of benzene with such low molecular weight olefins will contain from 9 to 16 carbon atoms and, accordingly, will be of sufficient volatility to be useful as components of gasoline or diesel fuels.

TABLE I

Alkylation Rate Constants for Various Aromatic Substrates upon Reaction with 1-Heptene at 204° C. over a Solid Phosphoric Acid Catalyst.

| Compound | Rate Constant, $min^{-1}$ |
|---|---|
| Thiophene | 0.077 |
| 2-Methylthiophene | 0.046 |
| 2,5-Dimethylthiophene | 0.004 |
| Benzothiophene | 0.008 |
| Benzene | 0.001 |
| Toluene | 0.002 |

The alkylation of sulfur-containing aromatic impurities in the feedstock to the olefin-modification reaction zone results in the formation of higher boiling sulfur-containing products. Accordingly, such materials can be removed by fractionation of the reaction zone effluent on the basis of boiling point. As a very crude approximation, each carbon atom in the side chain of a monoalkylated thiophene adds about 25° C. to the 84° C. boiling point of thiophene. As an example, 2-octylthiophene has a boiling point of 259° C., which corresponds to a boiling point increase of 23° C. over that of thiophene for each carbon atom in the eight carbon alkyl group. Accordingly, monoalkylation of thiophene with a $C_7$ to $C_{15}$ olefin in the olefin-modification reaction zone will usually yield a sulfur-containing alkylation product which has a high enough boiling point to be easily removed by fractional distillation as a component of a high boiling fraction which has an initial boiling point of about 210° C.

The alkylation of a sulfur-containing aromatic compound by an olefin is illustrated by the mono-alkylation of thiophene with propene to yield either 2-isopropylthiophene or 3-isopropylthiophene. The higher molecular weight of such an alkylation product is reflected by a higher boiling point relative to that of the starting material. In one embodiment of the invention, reaction conditions in the olefin-modification reaction zone are selected so that a major portion of any sulfur-containing aromatic impurities in the feedstock are converted to higher boiling sulfur-containing products.

Mercaptans are a class of organic sulfur-containing compounds which frequently appear in significant quantity as impurities in the hydrocarbon liquids which are conventionally encountered in the refining of petroleum. For example, straight run gasolines, which are prepared by simple distillation of crude oil, will frequently contain significant amounts of mercaptans and sulfides as impurities. Unlike sulfur-containing aromatic compounds, mercaptans are believed to be relatively inert to the reaction conditions employed in the olefin-modification reaction zone. In addition, benzothiophenic compounds and some multisubstituted thiophenes, such as certain 2,5-dialkylthiophenes, will also be relatively unreactive under the conditions employed in the olefin-modification reaction zone. Accordingly, a large proportion of the mercaptans in the feedstock and significant amounts of certain relatively unreactive sulfur-containing aromatic compounds can survive the reaction conditions in the olefin-modification reaction zone.

In the practice of this invention, the feedstock is contacted with the olefin-modification catalyst within the olefin-modification reaction zone at a temperature and for a period of time which are effective to result in the desired reduction of the feedstock's olefinic unsaturation as measured by bromine number. The contacting temperature will be desirably in excess of about 50° C., preferably in excess of 100° C. and more preferably in excess of 125° C. The contacting will generally be carried out at a temperature in the range from about 50° C. to about 350° C., preferably from about 100° C. to about 350° C., and more preferably from about 125° C. to about 250° C. It will be appreciated, of course, that the optimum temperature will be a function of the olefin-modification catalyst used, the olefin concentration in the feedstock, the type of olefins present in the feedstock, and the type of aromatic compounds in the feedstock that are to be alkylated.

The feedstock can be contacted with the olefin-modification catalyst in the olefin-modification reaction zone at any suitable pressure. However, pressures in the range from about 0.01 to about 200 atmospheres are desirable, and a pressure in the range from about 1 to about 100 atmospheres is preferred. When the feedstock is simply allowed to flow through a catalyst bed, it is generally preferred to use a pressure at which the feed will be a liquid.

In a highly preferred embodiment of the invention, the conditions utilized in the olefin-modification reaction zone are selected so that no significant cracking of paraffins in the feedstock takes place. For example, desireably less than 10% of the paraffins in the feedstock will be cracked, preferably less than 5% of the paraffins will be cracked, and more preferably less than 1% of the paraffins will be cracked. It is believed that any significant cracking of paraffins will result in the formation of undesirable by-products, for example, the formation of low molecular weight compounds which results in gasoline volume loss.

In the practice of the invention, the effluent from the olefin-modification reaction zone is fractionated on the basis of volatility into at least two fractions. The distillation endpoint of the lowest boiling fraction is desirably chosen to be such that it is below the temperature at which substantial amounts of benzothiophene are distilled. Since the boiling point of benzothiophene is 221° C., the distillation endpoint of this low boiling fraction will typically be selected such that it is below about 221° C. However, benzothiophene can form low boiling azeotropes with some of the components of the hydrocarbon liquids in which it typically occurs as an impurity. Because of such azeotrope formation, the distillation endpoint of the lowest boiling fraction will be preferably below about 199° C. and more preferably below about 190° C. A desirable distillation endpoint for the lowest boiling fraction will be in the range from about 135° C. to about 221° C., since this will serve to exclude benzothiophenic compounds and also some multisubstituted thiophenes, such as certain 2,5-dialkylthiophenes, which are usually difficult to alkylate and may survive the reaction conditions in the olefin-modification reaction zone. A highly desirable distillation endpoint for the lowest boiling fraction will be in the range from about 150° C. to about 190° C.

The lowest boiling fraction from fractionation of the effluent from the olefin-modification reaction zone is contacted with a hydrodesulfurization catalyst in the presence of hydrogen under conditions which are effective to convert at least a portion of the sulfur in its sulfur-containing organic impurities to hydrogen sulfide. In a highly preferred embodiment, at least a portion of the higher boiling fraction or fractions are also contacted with a hydrodesulfurization catalyst in the presence of hydrogen under conditions which are effective to convert at least a portion of the sulfur in its sulfur-containing organic impurities to hydrogen sulfide.

The hydrodesulfurization catalyst can be any conventional catalyst, for example, a catalyst comprised of a Group VI and/or a Group VIII metal which is supported on a suitable substrate. The Group VI metal is typically molybdenum or tungsten, and the Group VIII metal is typically nickel or cobalt. Typical combinations include nickel with molybdenum and cobalt with molybdenum. Suitable catalyst supports include, but are not limited to, alumina, silica, titania, calcium oxide, magnesia, strontium oxide, barium oxide, carbon, zirconia, diatomaceous earth, and lanthanide oxides. Preferred catalyst supports are porous and include alumina, silica, and silica-alumina.

The particle size and shape of the hydrodesulfurization catalyst will typically be determined by the manner in which the reactants are contacted with the catalyst. For example, the catalyst can be used as a fixed bed catalyst or as an ebulating bed catalyst.

The hydrodesulfurization reaction conditions used in the practice of this invention are conventional in character. For example, the pressures can range from about 15 to abut 1500 psi (about 1.02 to about 102.1 atmospheres); the temperature can range from about 50° C. to about 450° C., and the liquid hourly space velocity can range from about 0.5 to about 15 LHSV. The ratio of hydrogen to hydrocarbon feed in the hydrodesulfurization reaction zone will typically range from about 200 to about 5000 standard cubic feet per barrel. The extent of hydrodesulfurization will be a function of the hydrodesulfurization catalyst and reaction conditions selected and also the precise nature of the sulfur-containing organic impurities in the feed to the hydrodesulfurization reaction zone. However, the hydrodesulfurization process conditions will be desirably selected so that at least about 50% of the sulfur content of the sulfur-containing organic impurities is converted to hydrogen sulfide, and preferably so that the conversion to hydrogen sulfide is at least about 75%.

After removal of hydrogen sulfide, the product from hydrodesulfurization of the lowest boiling fraction from the olefin-modification reaction zone will have a sulfur content which is desirably less than 50 ppm by weight, preferably less than 30 ppm by weight, and more preferably less than 20 ppm by weight. The octane of this hydrodesulfurization product will be desirably at least 93% that of the feedstock to the olefin-modification reaction zone, preferably at least 95% that of said feedstock, and more preferably at least 97% that of said feedstock. Unless otherwise specified, the term octane as used herein refers to an (R+M)/2 octane, which is the sum of a material's research octane and motor octane divided by 2.

In those embodiments wherein a higher boiling fraction or fractions are also subjected to hydrodesulfurization, the resulting product or products, after removal of hydrogen sulfide, will also have a sulfur content which is desirably less than 50 ppm by weight, preferably less than 30 ppm by weight, and more preferably less than 10 ppm by weight. In addition, the octane of such product or products will also be desirably at least 94% that of the feedstock to the olefin-modification reaction zone, preferably at least 96% that of said feedstock, and more preferably at least 98% that of said feedstock.

The reaction conditions employed for hydrodesulfurization of the lowest boiling fraction from the olefin-modification reaction zone can be extremely mild since the sulfur-containing impurities will typically be comprised of materials, such as mercaptans, which are easily hydrodesulfurized. The reaction conditions employed for hydrodesulfurizaton of the higher boiling fraction or fractions from the olefin-modification reaction zone will typically require reaction conditions which are somewhat more vigorous since the sulfur-containing impurities will typically be comprised of materials, such as thiophenic and benzothiophenic compounds, which are more difficult to hydrodesulfurize than mercaptans. Accordingly, a highly preferred embodiment of the invention will comprise the use of hydrodesulfurization reaction conditions for the higher boiling fraction or fractions from the olefin-modification reaction zone which are more severe than those which are used for the lowest boiling fraction. It will be appreciated that the temperature, pressure, amount of hydrogen, and space velocity can be selected to control the severity of the hydrodesulfurization which is carried out on a given fraction.

In a highly preferred embodiment, the most volatile fraction from the olefin-modification reaction zone will be subjected to very mild hydrodesulfurization conditions, for example, the use of a temperature in the range from about 100° to about 300° C., a pressure in the range from about 50 psi to about 300 psi (about 3.40 to about 20.4 atmospheres), and a liquid hourly space velocity in the range from about 4 to about 8 LHSV. Higher boiling fractions from the olefin-modification zone will, preferably, be subjected to somewhat more vigorous hydrodesulfurization conditions, for example, the use of a temperature in the range from about 250° C. to about 450° C., a pressure in the range from about 300 psi to about 700 psi (about 20.4 to about 47.6 atmospheres), and a liquid hourly space velocity in the range from about 4 to about 8 LHSV.

The hydrodesulfurization process results in the conversion of the sulfur of sulfur-containing organic impurities to hydrogen sulfide, an inorganic gas which is easily removed by conventional procedures from the effluent of a hydrodesulfurization reaction zone to yield a product which has a reduced sulfur content. The resulting hydrodesulfurized products of the invention have an octane which is little changed relative to that of the feedstock to the olefin-modification reaction zone. Although a substantial portion of the olefin content of the feed to a hydrodesulfurization reaction zone undergoes hydrogenation and is converted to paraffins, this does not result in a large decrease in octane number relative to that of the feedstock to the olefin-modification reaction zone. Although the invention is not to be so limited, it is believed that olefins of little or no branching in the feedstock are converted to highly branched olefins in the olefin-modification reaction zone. When hydrogenated in a hydrodesulfurization reaction zone, these highly branched olefins are converted to highly branched paraffins which, in many cases, will have a larger octane number than the highly branched olefins from which they are derived. In contrast, the hydrogenation of olefins which have little or no branching and are representative of the olefins typically found in catalytic cracking products results in the formation of paraffins which have a lower octane than the olefins.

One embodiment of the invention is schematically illustrated in the drawing. With reference to the drawing, a heavy naphtha from a fluidized catalytic cracking process is passed through line 1 into pretreatment vessel 2. The heavy naphtha feedstock is comprised of mixture hydrocarbons which include olefins, paraffins, naphthenes, and aromatics, and the olefin content is in the range from about 10 wt. % to about 30 wt. %. In addition, the heavy naphtha feedstock contains from about 0.2 wt. % to about 0.5 wt. % sulfur in the form of sulfur-containing organic impurities, which include thiophene, thiophene derivatives, benzothiophene and benzothiophene derivatives, mercaptans, sulfides and disulfides. The feedstock also contains from about 50 to about 200 ppm by weight of basic nitrogen containing impurities.

The basic nitrogen containing impurities are removed from the feedstock in pretreatment vessel 2 through contact with an acidic material, such as an aqueous solution of sulfuric acid, under mild contacting conditions which do not cause any significant chemical modification of the hydrocarbon components of the feedstock.

Effluent from pretreatment vessel 2 is passed through line 3 and is introduced into olefin-modification reactor 4, which contains an olefin-modification catalyst. The feed to reactor 4 passes through the reactor where it contacts the olefin-modification catalyst under reaction conditions which are effective to produce a product having a bromine number which is lower than that of the feed from line 3. In addition, a substantial portion of the thiophenic and benzothiophenic impurities are converted to higher boiling sulfur-containing material through alkylation by the olefins in the feed.

The products from olefin-modification reactor 4 are discharged through line 5 and are passed to distillation column 6 where these products are fractionally distilled. A high boiling fraction, which has an initial boiling point of about 177° C. and comprises a hydrocarbon mixture which contains alkylated sulfur-containing impurities, is withdrawn from distillation column 6 through line 7. A low boiling fraction, which is of reduced sulfur content relative to the sulfur content of the original heavy naphtha feedstock and has a distillation endpoint of about 177° C., is withdrawn from distillation column 6 through line 8.

The high boiling fraction from distillation column 6 is passed through line 7 and is introduced into hydrodesulfurization reactor 9, and hydrogen is introduced into reactor 9 through line 10. The high boiling fraction is contacted with a hydrodesulfurization catalyst within reactor 9 in the presence of hydrogen under conditions which are effective to convert at least a portion of the sulfur in the sulfur-containing impurities of the feed from line 7 to hydrogen sulfide. A product is withdrawn from reactor 9 through line 11 which, after removal of hydrogen sulfide, has a reduced sulfur content relative to that of the feed from line 7. The sulfur content of this product will, typically, be less than about 30 ppm by weight.

The low boiling fraction from distillation column 6 is passed through line 8 and is introduced into hydrodesulfurization reactor 12, and hydrogen is introduced into reactor 12 through line 13. The low boiling fraction is contacted with a hydrodesulfurization catalyst within reactor 12 in the presence of hydrogen under conditions which are effective to convert at least a portion of the sulfur in the sulfur-containing impurities of the feed from line 8 to hydrogen sulfide. A product is withdrawn from reactor 12 through line 14 which, after removal of hydrogen sulfide, has a reduced sulfur content relative to both the heavy naphtha feedstock to the process and the feed from line 8. The sulfur content of this product will, typically, be less than about 30 ppm by weight.

The following example is intended only to illustrate the invention and is not to be construed as imposing limitations on the invention.

EXAMPLE

A naphtha feedstock, having an initial boiling point of 52° C. and a final boiling point of 227° C., was obtained by: (1) fractional distillation of the products from the fluidized catalytic cracking of a gas oil which contained sulfur-containing impurities; (2) washing the resulting naphtha fraction of above-stated boiling range with a 15 wt. % aqueous sulfuric acid solution in a drum mixer using a ratio of 10 parts of the naphtha fraction to 1 part of the aqueous sulfuric acid; and (3) drying the acid-washed naphtha to a water content of about 120 ppm by weight. Analysis of the naphtha feedstock, using a multicolumn gas chromatographic technique, showed it to contain on a weight basis: 10.09% paraffins, 20.84% olefins, 7.09% saturated naphthenes, 55.78% aromatics, and 6.19% unidentified material. The total sulfur content of the naphtha feedstock, as determined by X-ray fluorescence spectroscopy, was 860 ppm by weight, and about 95% of this sulfur content (i.e., 817 ppm by weight) was in the form of thiophene, thiophene derivatives, benzothiophene and benzothiophene derivatives (collectively referred to as thiophenic/benzothiophenic components). Substantially all of the sulfur-containing components which were not thiophenic/benzothiophenic (such as mercaptans, sulfides and disulfides) had a boiling point below 177° C. The naphtha feedstock had a total nitrogen content of 56 ppm by weight and a basic nitrogen content of less than 50 ppm by weight. In addition, the naphtha feedstock had an (R+M)/2 octane of 85.7 [the sum of a material's research octane and motor octane divided by 2 is referred to herein as "(R+M)/2"].

The naphtha feedstock was contacted in an olefin-modification reactor with a fixed bed of 12 to 18 mesh solid phosphoric acid catalyst on kieselguhr (obtained from UOP and sold under the name SPA-2) at a temperature of 191° C., a pressure of 200 psi (13.6 atmospheres), and a liquid hourly space velocity of 1.5 LHSV. The catalyst bed had a volume of 800 $cm^3$ and was held between two beds of inert glass beads in a tubular, stainless steel reactor of 2.54 cm internal diameter. The reactor had a total internal heated volume of about 2000 $cm^3$ and was held in a vertical orientation. The resulting product was separated into two fractions by fractional distillation: (1) 70 wt. % of the product as a low boiling fraction with a distillation endpoint of 177° C.; and (2) 30 wt. % of the product as a high boiling fraction or bottoms stream which had a final boiling point of 337° C. with about 10 vol. % of its material boiling above 227° C. The sulfur content, bromine number and (R+M)/2 octane of these two fractions and of the naphtha feedstock are set forth in Table II. These results demonstrate that the majority of the sulfur in the naphtha feedstock is concentrated in the high boiling fraction from the olefin-modification reactor. In addition, the results demonstrate a 38 to 41% reduction in the bromine number of the olefin-modification reactor product relative to the bromine number of the naphtha feedstock.

TABLE II

Properties of Olefin-Modification Reactor Feedstock and Products

| Process Stream | Sulfur Content, ppm by weight | Bromine Number | Octane, (R + M)/2 |
|---|---|---|---|
| Naphtha Feedstock | 860 | 37.6 | 85.7 |
| Low Boiling Fraction from Olefin-Modification Reactor | 96 | 23.3 | 85.7 |
| High Boiling Fraction from Olefin-Modification Reactor | 2640 | 22.1 | 85.6 |

The low boiling fraction from the olefin-modification reactor was subjected to hydrodesulfurization at a temperature of 232° C. and a pressure of 200 psi (13.6 atmospheres) in a tubular fixed-bed reactor of 1.3 cm internal diameter that was packed with 20 $cm^3$ of 0.050 inch (0.127 cm) CoMo/$Al_2O_3$ trilobe hydrotreating catalyst (obtained from Criterion) which was mixed with 80 $cm^3$ of particulate silicon carbide. A flow of hydrogen into the reactor was maintained at 1 standard cubic feet per hour (28.3 liters/hr). Hydrodesulfurization was evaluated in two different experiments, using a liquid hourly space velocity ("LHSV") of 4.0 in one experiment and 5.6 in the other. The properties of the resulting hydrodesulfurization products, after removal of hydrogen sulfide, are set forth in Table III. For comparison purposes, analytical data for the low boiling feed to the hydrodesulfurization reactor are also set forth in Table III. The results in Table III demonstrate that over 85% of the sulfur in the high boiling fraction from the olefin-modification reactor can be removed under extremely mild hydrotreating conditions at a penalty of only about 1 unit of (R+M)/2 octane.

TABLE III

Properties of Hydrodesulfurization Reactor Feed and Products.

| Process Stream | LHSV | Sulfur Content, ppm by weight | Bromine Number | Octane, (R + M)/2 |
|---|---|---|---|---|
| Low Boiling Feed from Olefin-Modification Reactor | — | 96 | 23.3 | 85.7 |
| Hydrodesulfurization Product (Experiment 1) | 4.0 | 12 | 15.2 | 84.7 |
| Hydrodesulfurization Product (Experiment 2) | 5.6 | 10 | 17.9 | 84.8 |

The high boiling fraction from the olefin-modification reactor was also subjected to hydrodesulfurization in a tubular fixed-bed reactor of 1.3 cm internal diameter that was packed with 20 $cm^3$ of 0.050 inch (0.127 cm) CoMo/$Al_2O_3$ trilobe hydrotreating catalyst (obtained from Criterion) which was mixed with 80 $cm^3$ of particulate silicon carbide. As described above, a flow of hydrogen into the reactor was maintained at 1 standard cubic feet per hour (28.3 liters/hr). Hydrodesulfurization was evaluated in four different experiments, using various combinations of temperature, pressure and liquid hourly space velocity ("LHSV"). The identity of these combinations are set forth in Table IV as are the properties of the resulting hydrodesulfurization products, after removal of hydrogen sulfide. Table IV also sets forth the properties of the high boiling feed to the reactor for comparison purposes. The results in Table IV demonstrate that over 99% of the sulfur content of the high boiling fraction from the olefin-modification reactor can be removed under mild hydrotreating conditions without causing any significant loss in (R+M)/2 octane.

TABLE IV

Properties of Hydrodesulfurization Reactor Feed and Products.

| Process Stream | Process Conditions, (LHSV/ atm/° C.) | Sulfur Content, ppm | Bromine Number | Octane, (R + M)/2 |
|---|---|---|---|---|
| High Boiling Feed from Olefin-Modification Reactor | — | 2640 | 22.1 | 85.6 |
| Hydrodesulfurization Product (Experiment 1) | 4.0/34/343 | 4 | 3.0 | 85.8 |
| Hydrodesulfurization Product (Experiment 2) | 5.6/34/343 | 5 | 3.5 | 85.3 |
| Hydrodesulfurization Product (Experiment 3) | 5.6/34/366 | 4 | 2.8 | 85.4 |
| Hydrodesulfurization Product (Experiment 4) | 4.0/13.6/343 | 12 | 6.5 | 85.1 |

We claim:

1. A process for producing products of reduced sulfur content from a feedstock, wherein said feedstock contains sulfur-containing organic impurities and basic nitrogen-containing impurities and is comprised of a normally liquid mixture of hydrocarbons which includes olefins, said process comprising:

(a) removing at least a portion of the basic nitrogen-containing impurities from the feedstock;

(b) contacting the feedstock with an olefin-modification catalyst in an olefin-modification reaction zone under conditions which are effective to produce a product which has a lower bromine number than that of the feedstock; wherein said olefin modification catalysts is selected from the group consisting of solid phosphoric acid catalysts and acidic polymeric resin catalysts;

(c) fractionating the product from said olefin-modification reaction zone to produce;

(i) a first fraction which contains sulfur-containing organic impurities and has a distillation endpoint which is in the range from about 135° C. to about 221° C.; and (ii) a second fraction which is higher boiling than the first fraction and contains sulfur-containing organic impurities; and (d) contacting said first fraction with a hydrodesulfurization catalyst in the presence of hydrogen in a first hydrodesulfurization reaction zone under conditions which are effective to convert at least a portion of the sulfur in said sulfur-containing impurities of the first fraction to hydrogen sulfide.

2. The process of claim 1 which additionally comprises contacting said second fraction with a hydrodesulfurization catalyst in the presence of hydrogen in a second hydrodesulfurization reaction zone under conditions which are effective to convert at least a portion of the sulfur in said sulfur-containing impurities of the second fraction to hydrogen sulfide.

3. The process of claim 2 which additionally comprises removing hydrogen sulfide from the effluent of said second hydrodesulfurization reaction zone to yield a desulfurized product having an octane which is at least 95% that of the feedstock to the olefin-modification reaction zone.

4. The process of claim 1 which additionally comprises removing hydrogen sulfide from the effluent of said first hydrodesulfurization reaction zone to yield a desulfurized product having an octane which is at least 95% that of the feedstock to the olefin-modification reaction zone.

5. The process of claim 1 wherein the bromine number of the product from said olefin-modification reaction zone is no greater than 80% that of the feedstock to the olefin-modification reaction zone.

6. The process of claim 5 wherein the bromine number of the product from said olefin-modification reaction zone is no greater than 70% that of the feedstock to the olefin modification reaction zone.

7. The process of claim 1 wherein said feedstock is comprised of hydrocarbons from a catalytic cracking process.

* * * * *